US010533325B2

(12) United States Patent
Marinucci

(10) Patent No.: US 10,533,325 B2
(45) Date of Patent: Jan. 14, 2020

(54) SHEET MATERIAL CONNECTOR

(71) Applicant: Robert Marinucci, Laguna Woods, CA (US)

(72) Inventor: Robert Marinucci, Laguna Woods, CA (US)

( * ) Notice: Subject to any disclaimer, the term of this patent is extended or adjusted under 35 U.S.C. 154(b) by 0 days.

(21) Appl. No.: 16/057,203

(22) Filed: Aug. 7, 2018

(65) Prior Publication Data

US 2019/0048598 A1 Feb. 14, 2019

Related U.S. Application Data

(60) Provisional application No. 62/542,576, filed on Aug. 8, 2017.

(51) Int. Cl.
*E04F 19/06* (2006.01)
*E04F 13/06* (2006.01)

(52) U.S. Cl.
CPC ..... *E04F 19/062* (2013.01); *E04F 13/06* (2013.01)

(58) Field of Classification Search
CPC ..... E04F 19/062; E04F 13/141; E04F 13/06
See application file for complete search history.

(56) References Cited

U.S. PATENT DOCUMENTS

| | | | | |
|---|---|---|---|---|
| 2,348,658 | A | 5/1944 | Slaughter | |
| 3,000,474 | A | 9/1961 | Friedman et al. | |
| 4,913,576 | A * | 4/1990 | Grant, Jr. | A47G 27/045 16/16 |
| 5,651,225 | A | 7/1997 | Leeks | |
| 5,799,458 | A | 9/1998 | Ferguson | |
| 9,631,377 | B2 * | 4/2017 | Browne | E04F 19/062 |
| 2002/0023398 | A1 | 2/2002 | Ito | |
| 2006/0000176 | A1 | 1/2006 | Taylor | |
| 2006/0123730 | A1 | 6/2006 | Wambaugh et al. | |
| 2007/0107348 | A1 | 5/2007 | Browne et al. | |
| 2010/0024339 | A1 * | 2/2010 | Tamlyn | E04B 1/7675 52/459 |
| 2010/0083599 | A1 | 4/2010 | Meulemans | |

FOREIGN PATENT DOCUMENTS

| | | | | |
|---|---|---|---|---|
| CN | 203213513 | U | 9/2013 | |
| JP | 05202599 | A | 8/1993 | |
| WO | WO-0016611 | A2 * | 3/2000 | A01K 1/0157 |

OTHER PUBLICATIONS

International Search Report and Written Opinion for International Application No. PCT/US2018/045568, Search completed Sep. 22, 2018, dated Oct. 15, 2018, 15 pgs.

* cited by examiner

*Primary Examiner* — Patrick J Maestri
(74) *Attorney, Agent, or Firm* — KPPB LLP

(57) ABSTRACT

Apparatus and methods for joining sections of sheet material (e.g., drywall) are provided. The sheet material joining apparatus or connector comprises an elongated body having two channels disposed such that the ends of two sections of sheet material may be secured therein. The channels are defined by front and back walls interconnected via an internal rib. The front wall is configured to be disposed on the exposed side of the sheet material and the back wall is configured to be disposed on the back or hidden side of the sheet material, while the back wall takes the form of a convex arced surface. The convex arced surface is configured to be engaged by one or more securing elements (e.g., screw), and during such engagement to exert a resilient force onto the adjoining sections of sheet material to draw them inward toward the back wall of the connector.

19 Claims, 18 Drawing Sheets

SHEET MATERIAL CONNECTOR

CROSS-REFERENCE TO RELATED APPLICATIONS

The current application claims priority to U.S. Provisional Patent Application No. 62/542,576, filed Aug. 8, 2017, the disclosure of which is incorporated herein by reference.

FIELD OF THE INVENTION

The invention is generally directed to connectors that join together adjoining edges of sections of sheet material, and methods of their use.

BACKGROUND

In the field of the construction and repair of walls and ceilings, a challenge exists in joining together two adjacent sections of wallboard, drywall, plywood or the like into a contiguous, non-broken wall or ceiling. Specifically, it is difficult to join the pieces in a smooth and contiguous manner without bulges or depressions appearing in the finished, wall. Given the extreme planar nature of modern sheet material, such unevenness is obvious to any viewer of the finished wall, leading to an unsatisfactory final effect.

One common occurrence that makes the joining of two sections of wallboard even more challenging is that when the two sections of sheet material are joined together, the point at which the sheets are joined often does not overlap with a supporting stud or beam. As a result, there is not proper support for the sheet material. This lack of support can exacerbate the unevenness between sections of wall requiring additional labor to smooth the walls out using a spreadable overlay material, or cutting the sections of sheet material to ensure that they do coincide with an underlying support, which can lead to significant waste of sheet material.

SUMMARY OF THE INVENTION

In many embodiments, the invention is directed to methods and apparatus for joining together adjoining sections of a sheet material, such as, for example, drywall.

Many embodiments are directed to sheet material connectors including:

- an elongated body having first and second walls disposed parallel to one another and interconnected at the midpoint thereof by a connecting wall disposed perpendicular thereto;
- wherein the second wall is a substantially curved elongated planar surface defining an arc concave to the connecting wall, and has a width greater than the first wall;
- wherein the distance between the first and second walls defines a pair of channels separated by the connecting wall, each configured to accept a portion of a sheet material body therein; and
- wherein the curved surface of the second wall is configured to apply a resilient force to the portion of the sheet material body disposed within the pair of channels.

In other embodiments the longitudinal edges of the second wall are angled outward from the pair of channels.

In still other embodiments the sheet material connector is formed of a material selected from the group consisting of metal, polymeric materials and cellulosic materials.

In yet other embodiments the sheet material connector is translucent.

In still yet other embodiments the width of the pair of channels is selected from the group consisting of ¼ inch, ½ inch, ⅝ inch, and ¾ inch.

In still yet other embodiments the first wall is a substantially flat elongated planar surface.

In still yet other embodiments the connecting wall is a substantially flat elongated planar surface.

Many other embodiments are directed to methods for adjoining sections of sheet material including:

- providing a sheet material connector comprising:
- an elongated body having first and second walls disposed parallel to one another and interconnected at the midpoint thereof by a connecting wall disposed perpendicular thereto,
- wherein the second wall is a substantially curved elongated planar surface defining an arc concave to the connecting wall, and has a width greater than the first wall,
- wherein the distance between the first and second walls defines a pair of channels separated by the connecting wall, each configured to accept a portion of a sheet material body therein;
- inserting a portion of different sheet material bodies into each of the channels, such that the first wall overlaps an outer front surface of each of the different sheet material bodies and such that the second wall overlaps an outer back surface of each of the different sheet material bodies, and wherein the ends of the sheet material bodies abut adjacent the connecting wall; and
- inserting at least one fastener through the outer front surface of each of the different sheet material bodies and into the second wall, and tightening each of the at least one fasteners such that the curved elongated planar surface of the second wall applies a resilient force to the ends of each of the different sheet material bodies to draw said ends back toward the second wall.

In other embodiments the longitudinal edges of the second wall are angled outward from the pair of channels.

In still other embodiments the sheet material connector is formed of a material selected from the group consisting of metal, polymeric materials and cellulosic materials.

In yet other embodiments the sheet material connector is translucent.

In still yet other embodiments the width of the pair of channels is selected from the group consisting of ¼ inch, ½ inch, ⅝ inch, and ¾ inch.

In still yet other embodiments the first wall is a substantially flat elongated planar surface.

In still yet other embodiments the connecting wall is a substantially flat elongated planar surface.

In still yet other embodiments the sheet material is drywall.

In still yet other embodiments a plurality of fasteners are inserted through the outer front surface of each of the different sheet material bodies.

In still yet other embodiments the fasteners are threaded fasteners.

In still yet other embodiments the sheet material connector is installed on a vertical surface.

In still yet other embodiments the sheet material connector is install on a horizontal surface.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description and claims will be more fully understood with reference to the following figures and data graphs, which are presented as exemplary embodiments of the invention and should not be construed as a complete recitation of the scope of the invention.

DETAILED DESCRIPTION

Turning now to the drawings, apparatus and methods for joining sections of sheet material (e.g., drywall) are provided. Many embodiments of sheet material joining apparatus or connector comprise an elongated body having two channels disposed such that the ends of two sections of sheet material may be secured therein. In various embodiments the channels are defined by front and back walls interconnected via an internal rib. In some such embodiments the front wall is configured to be disposed on the exposed side of the sheet material and the back wall is configured to be disposed on the back or hidden side of the sheet material. In embodiments the back wall takes the form of a convex arced surface. In some such embodiments the convex arced surface is configured to be engaged by one or more securing elements (e.g., screw), and during such engagement to exert a resilient force onto the adjoining sections of sheet material to draw them inward toward the back wall of the connector.

According to embodiments, the connector may be used to join any suitable sheet materials. Although references may be made to drywall in particular example, it will be understood that the term sheet material as used in reference to the present invention refers to drywall, sheet rock, gypsum board, wallboard or similar wall panels. In embodiments, the joining may occur at any point along a framed wall without support such that framing members may take any desired configuration, such as, for example, 16", 18" or 24" on center. The channels and elongated bodies of the connector may be configured for any desired thickness and length of sheet material. The joining connector and methods in accordance with embodiments may be used for wall or ceiling installation.

Figure 1:
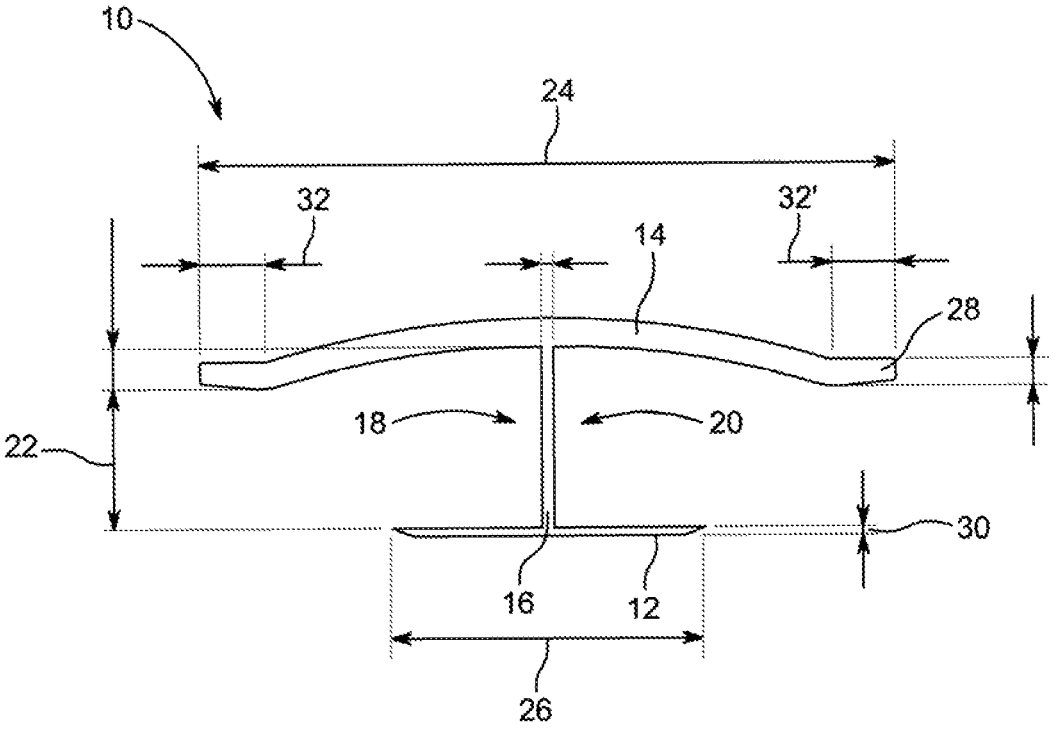
FIG. 1 provides a cross-sectional schematic of a sheet material joining apparatus according to embodiments.

Referring to FIG. 1, a cross-sectional view of an embodiment of a sheet material connector 10 is provided. As shown, in various embodiments the connector 10 comprises a body formed of three interconnected wall portions 12, 14 and 16 that combine to form two adjacent channels 18 and 20 that are dimensioned and configured to engage and adjoin the edges of two adjacent sections of sheet material (not shown). As also shown, the wall portions are arranged such that a front wall portion 12 and a rear wall portion 14 form a pair of generally planar surfaces arranged parallel to each other and interconnected at their midpoints by a connecting wall portion 16 arranged transverse to the planes of the front and rear wall portions. When attached to a section of sheet material the front wall portion 12 is configured to be disposed on the exposed or front side of the sheet material, the rear wall portion 14 is configured to be disposed on the back or inward-facing side of the sheet material, and the connecting wall portion 16 is configured to be disposed such that the two adjacent edges of the sections of sheet material are abutted against the two faces thereof, (this arrangement will be described in greater detail below).

In various embodiments, the connecting wall portion 16 is dimensioned 22 such that the channels 18 and 20 are sufficiently sized to allow the sheet materials to be loaded into the channels and held thereby. In some such embodiments the channels 18 and 20 may have a width dimension 22 such that they are slightly smaller than the width of the sheet material to be joined such that the walls apply a resilient force thereto. In other embodiments the channels may have a dimension 22 such that they are slightly larger than the width of the sheet material to be joined such that they may be inserted without damage thereto.

In some embodiments, as shown in FIG. 1, the rear wall 14 has a width 24 longer than the width 26 of the front wall 12. A wider rear wall 16 allows for the sheet material to be loaded in at an angle from the side with minimal interference and damage to the edge of the sheet material. The rear wall 14 may also be formed with an upturned leading edge 28 to further encourage the sheet material into the channels 18 and 20 of the connector with damage. Embodiments configured with a narrower and thinner 30 front wall 12, as shown in FIG. 1, may also be provided such that the front wall presents the smallest profile possible to ensure that there are minimal visual bulges or discontinuities present on the exposed side of the wall that would need to be smoothed with tape or smoothing compound to present a flat-surfaced finished wall.

Finally, as shown in the cross-section, in many embodiments the rear wall 12 is formed as a curved arced surface concave to the connecting wall such that the wall exerts a resilient load force on sheet material inserted into the channels 18 and 20. As will be described in greater detail below, these arced portions 32 and 32' of the rear wall 14 are also configured to be used in conjunction with attachment means (e.g., screws and other fasteners) to place tension on the arced wall, thereby increasing the resilient force being placed on the two adjoined sections of sheet material, thus causing the edges of the sheet material to draw into the bay or cavity between the wall studs at the rear of the sheet material wall to further minimize the formation of bulges or discontinuities in the finished wall.

In embodiments, the connector 10 may be fabricated from any material suitable to provide sufficient support to the ends of the sheet material. In particular, the connector 10 may be made of a material sufficiently rigid to substitute for traditional support structures, thereby enabling the connector to be used at wall locations in which no stud is provided, or to use the connector as a substitute for a conventional support structure (e.g., wooden or metal stud) at an intermediate location of the wall. Exemplary materials include, for example, metals (e.g., aluminum or steel), polymeric materials (e.g., plastics such as PVC, etc.), and cellulosic material (e.g., compressed cardboard).

Figure 2A:
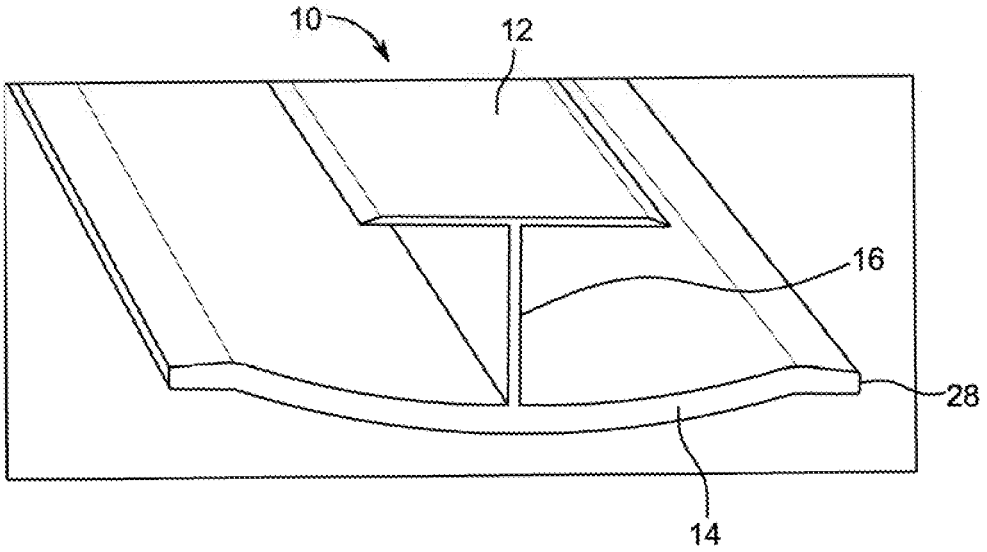
FIGS. 2*a* and 2*b* provide: 2*a*) cross-sectional; and 2*b*) schematic images of an exemplary sheet material joining apparatus according to embodiments.
Figure 2B:
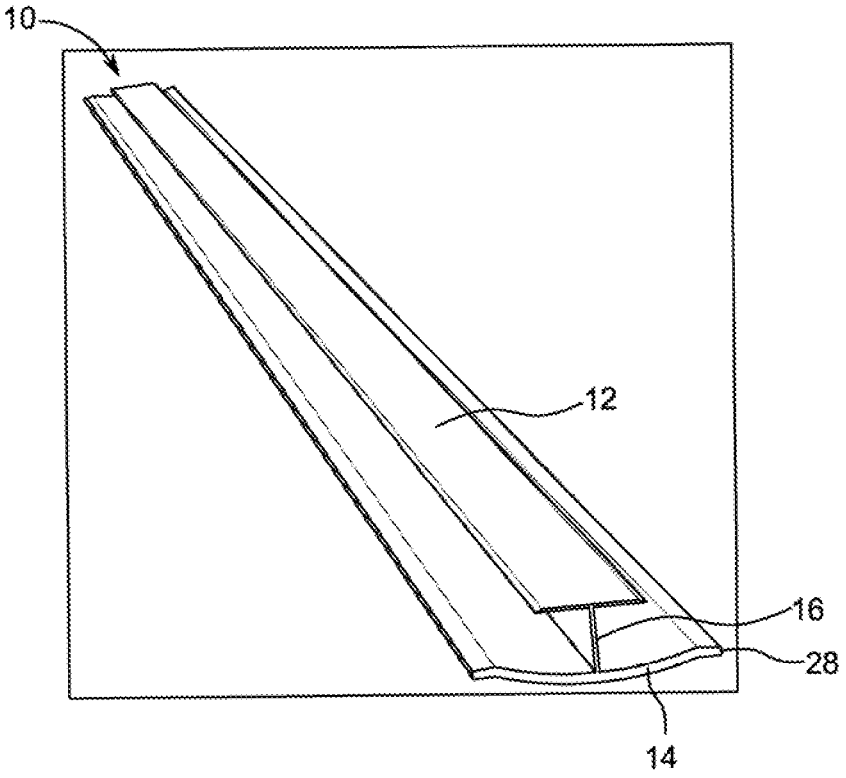

The connector can be provided in lengths of 4 ft., 8 ft., 12 ft. and 14 ft., which are common drywall width and length dimensions or other customized lengths. The connector can be used on horizontal or vertical orientation extending vertical wall drywall applications or on ceilings (as will be described in greater detail below. The connector may be any color or consistency. In some applications, the connector may be translucent to allow the edges of the drywall to be visible. The connector may be dimensioned for standard ground thickness for drywall such as ¼ in., ½ in., ⅝ in., ¾ in. or other smaller or larger ground thickness drywalls. Images of exemplary embodiments of such connectors may be seen, for example, in FIGS. 2*a* and 2*b*.

Figure 3:
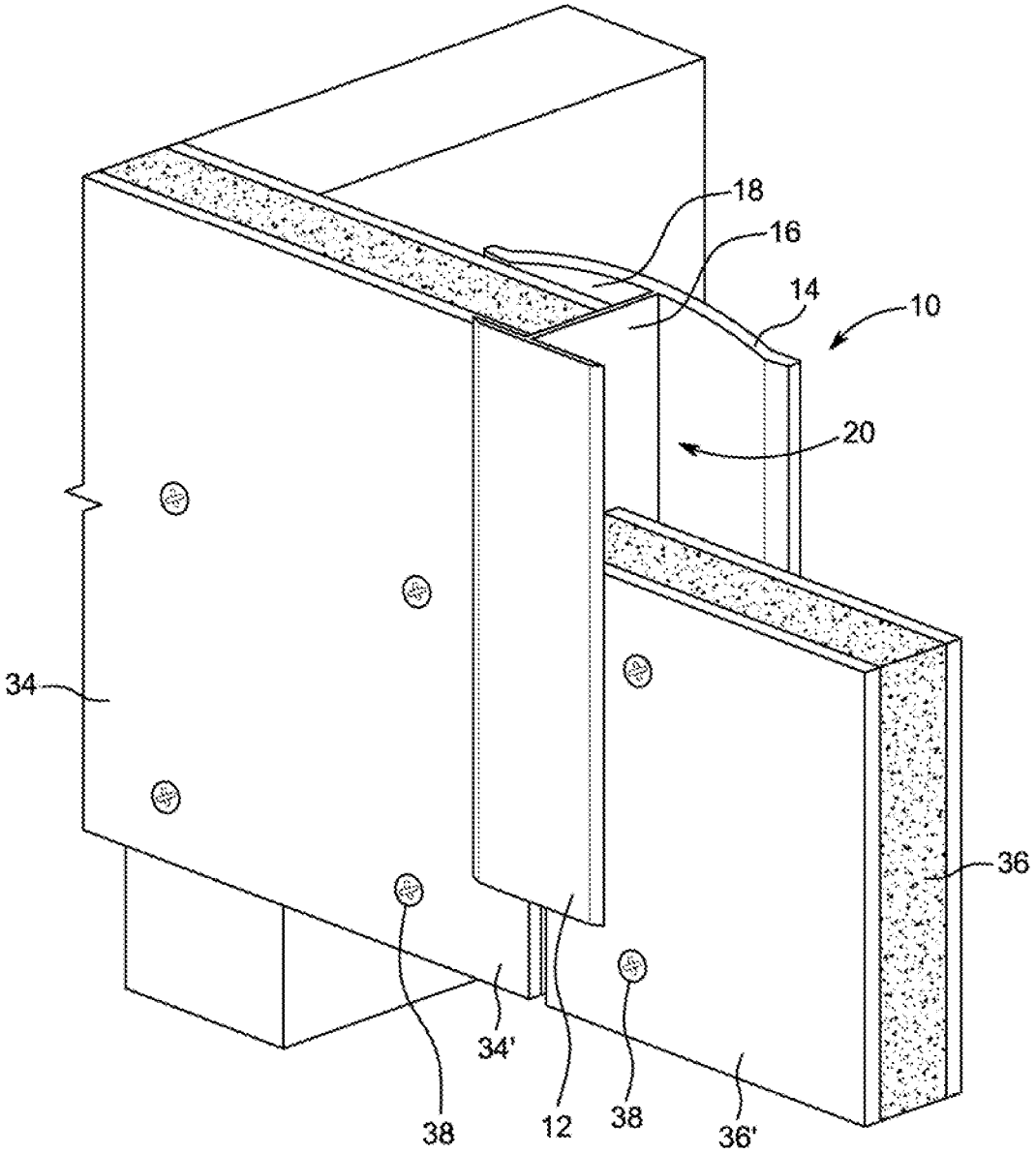
FIG. 3 provides a schematic of an installed sheet material joining apparatus according to embodiments.

Referring to FIG. 3, when two sections 34 and 36 of sheet material are to be joined together, the connector 10 is positioned so that the edges 34' and 36' of the sections of sheet materials are disposed in the channels 18 and 20, and front and rear walls 12 and 14 lie flat against opposite sides of the sections of sheet material, and so that the connector wall portion 16 of the connector 10 is sandwiched between abutting ends of the sheet material pieces. (Exemplary illustrations of these steps are provided in FIGS. 4*a* to 4*g*.)

Figure 4A:
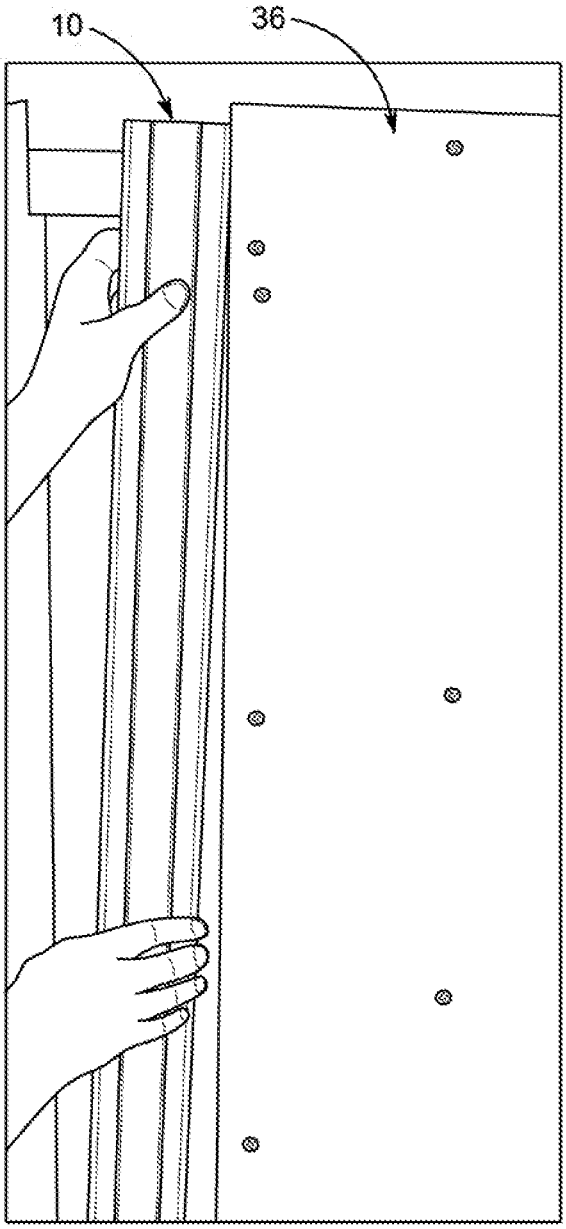
FIGS. 4*a* to 4*k* provide schematics of a process for using a sheet material joining apparatus according to embodiments to join two sections of wall sheet material together according to embodiments.
Figure 4B:
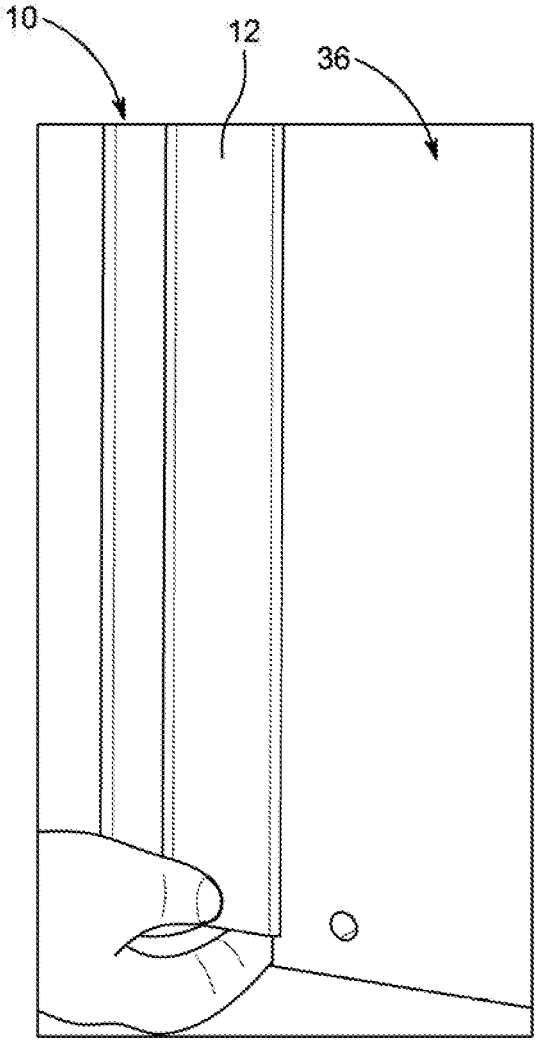
Figure 4C:
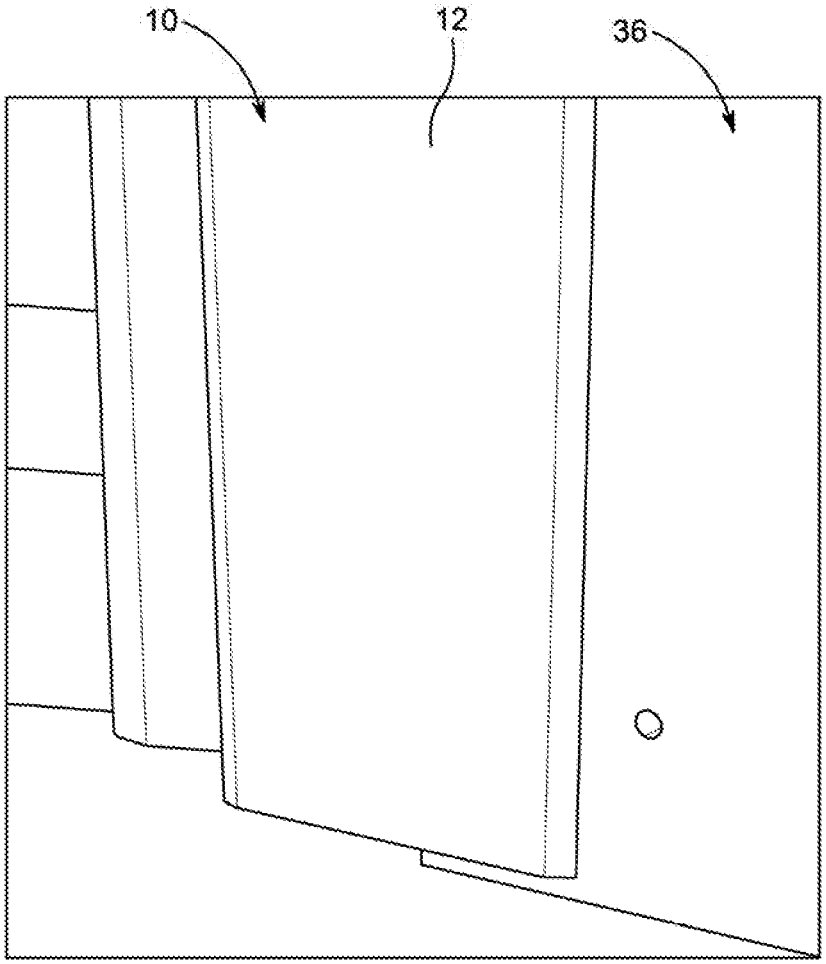
Figure 4D:
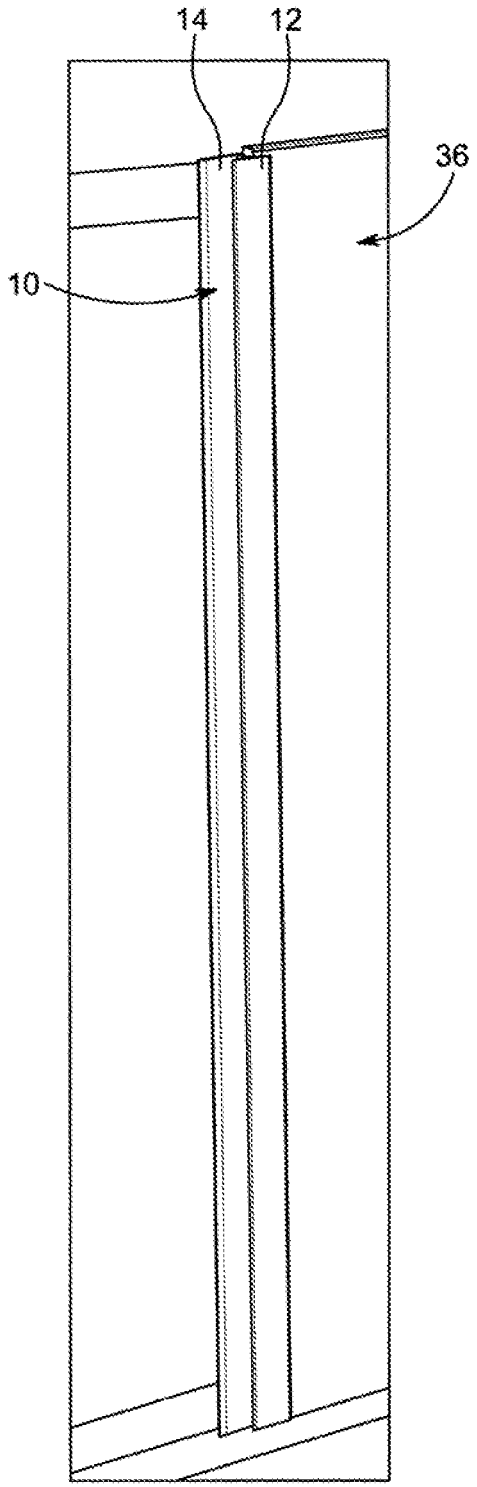
Figure 4E:
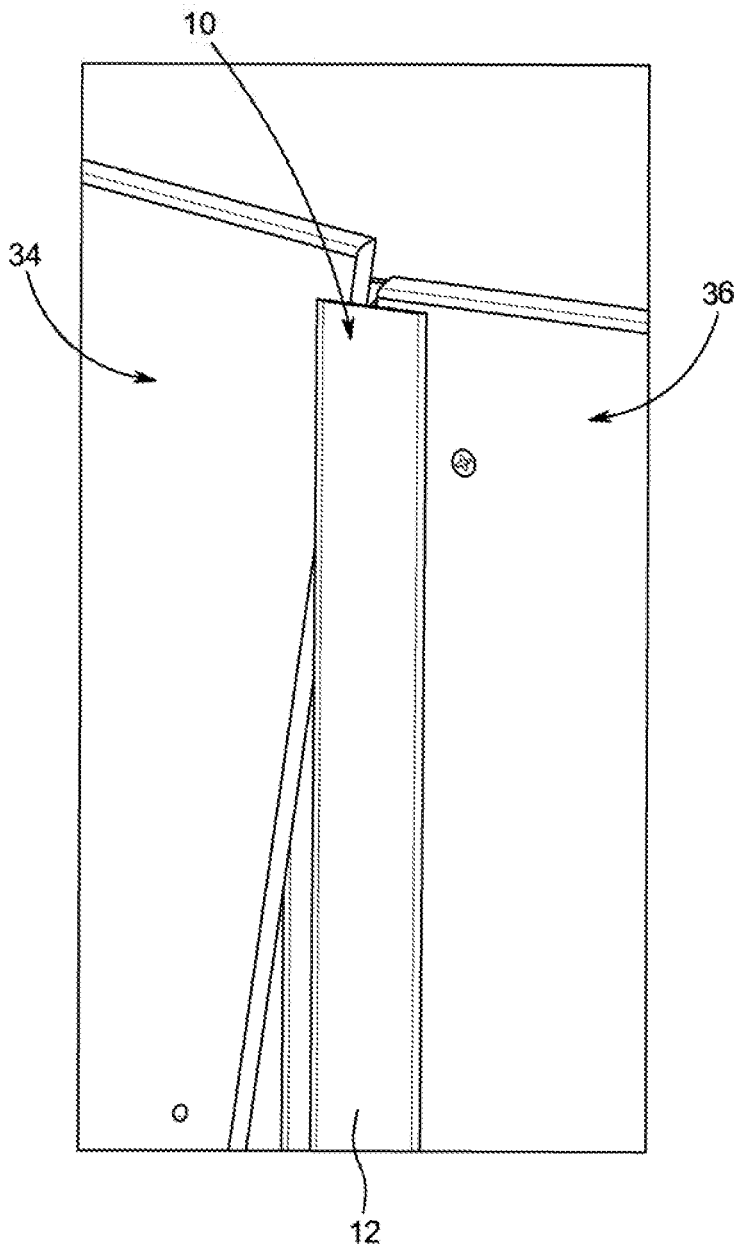
Figure 4F:
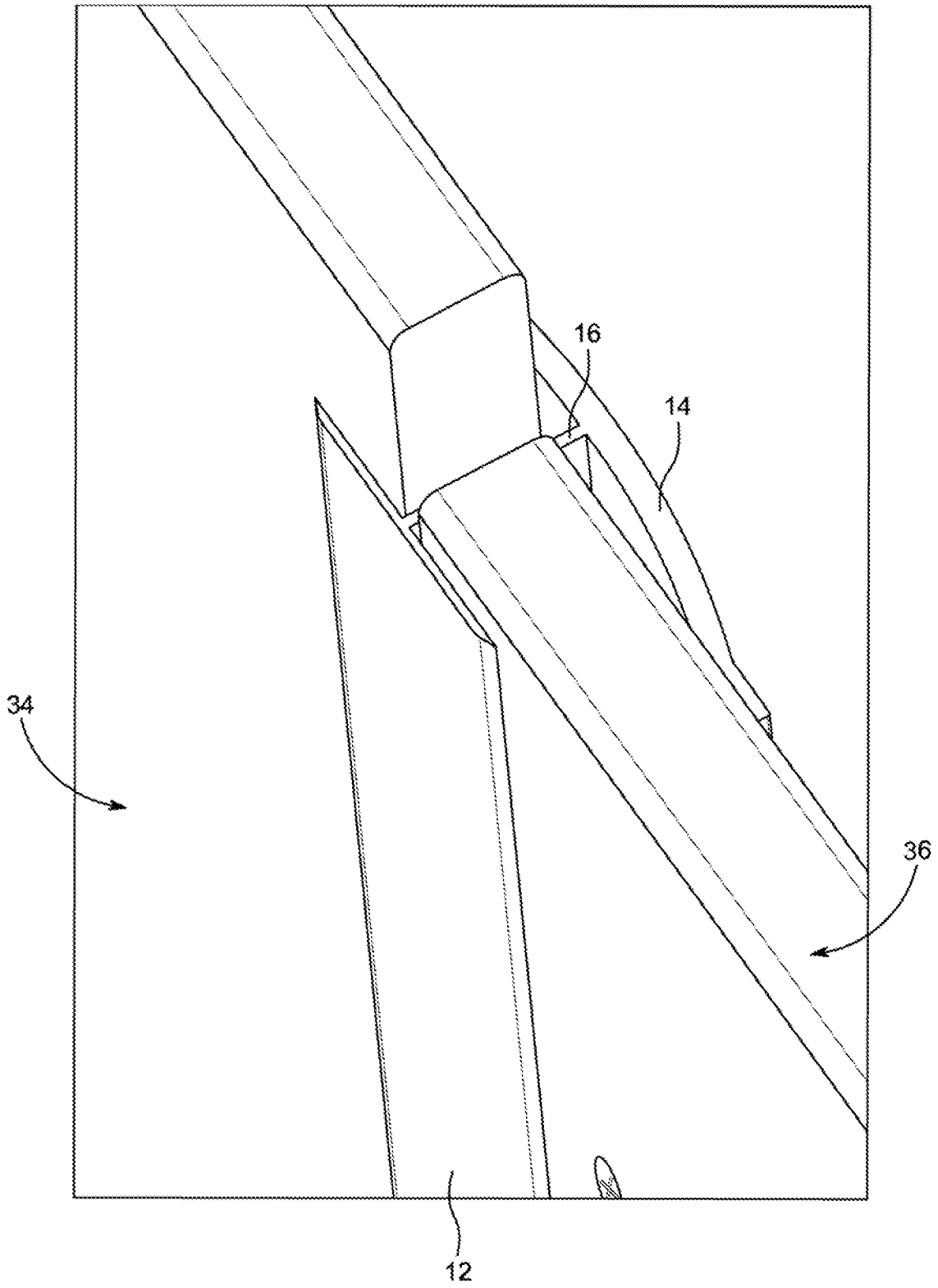
Figure 4G:
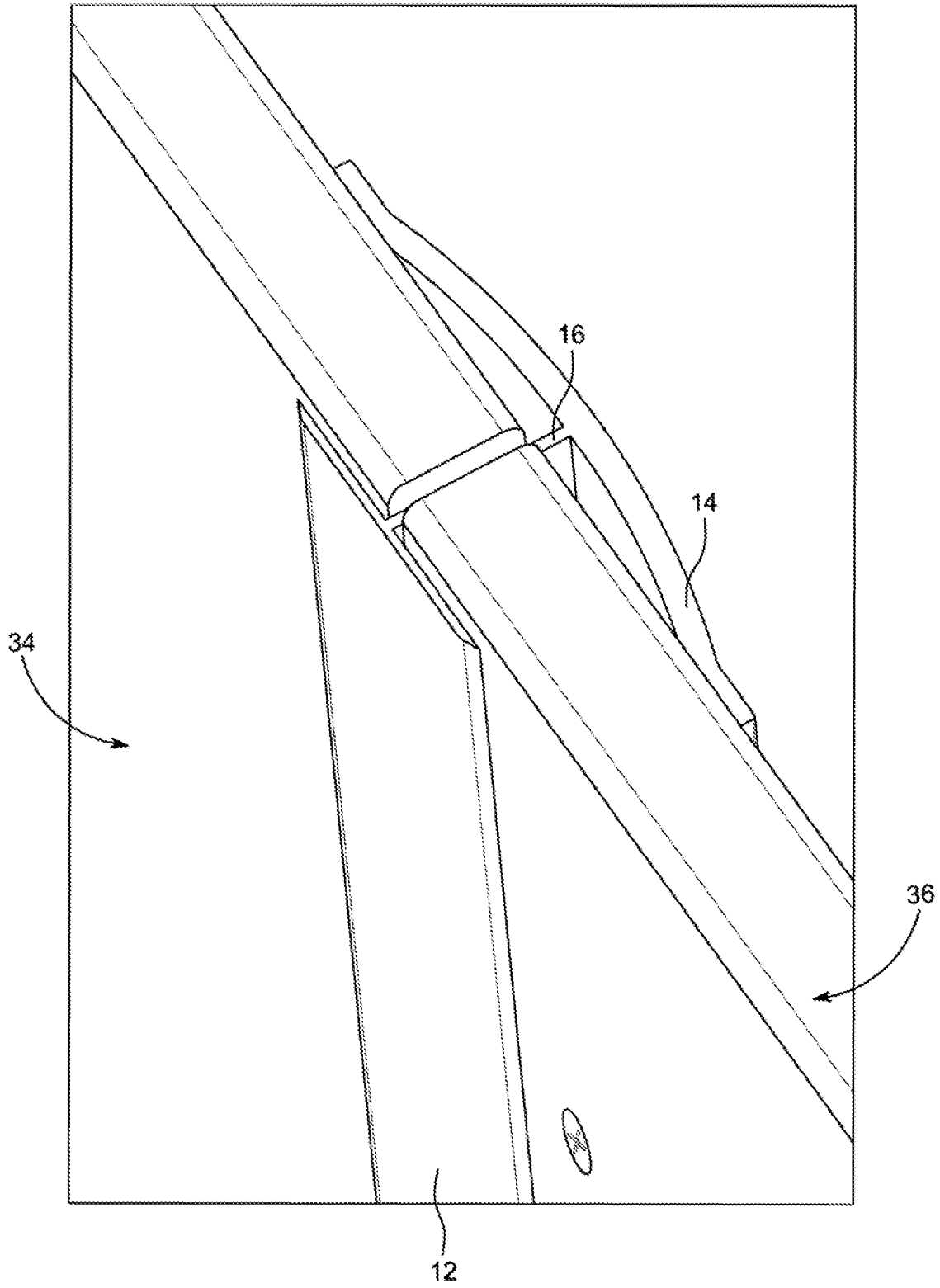
Figure 4H:
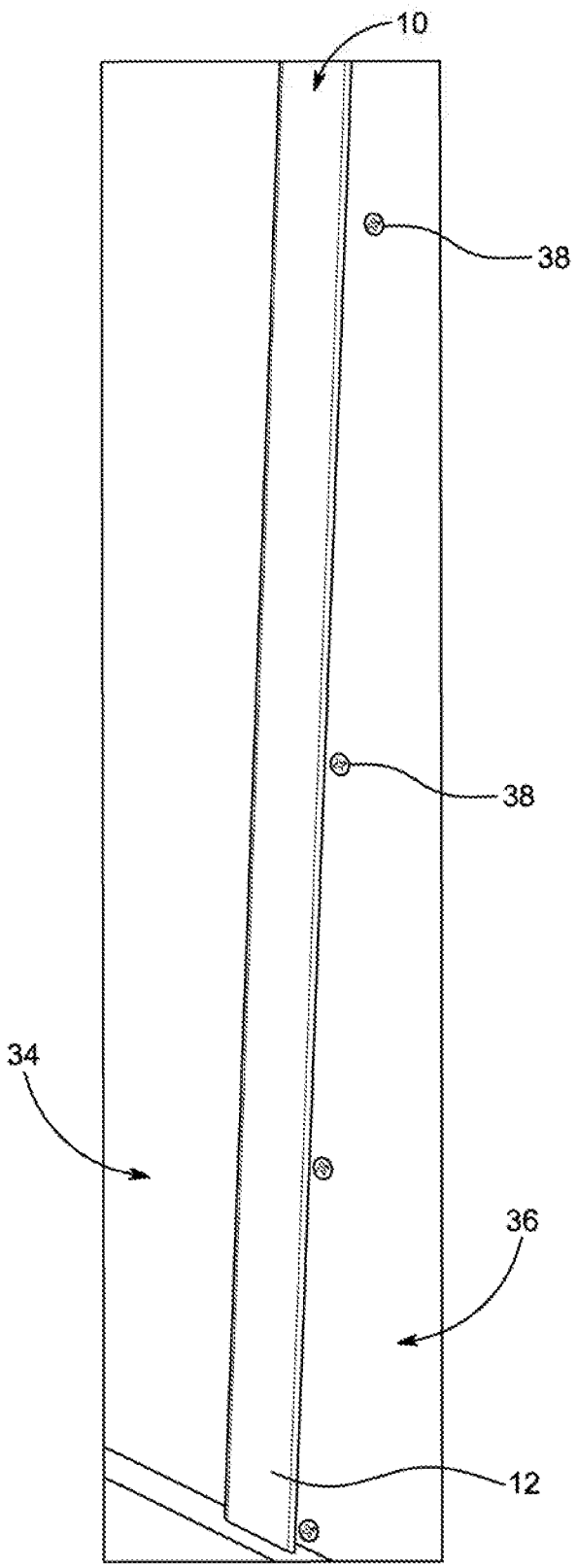
Figure 4I:
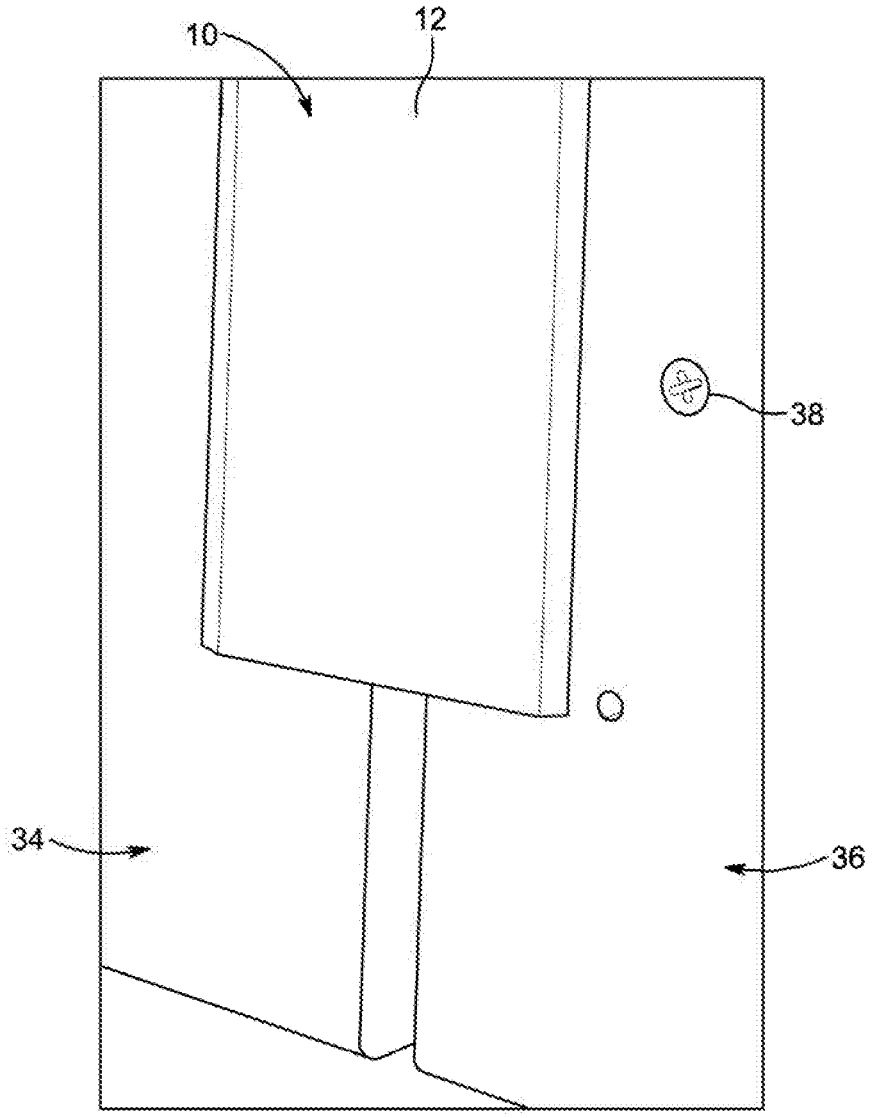
Figure 4J:
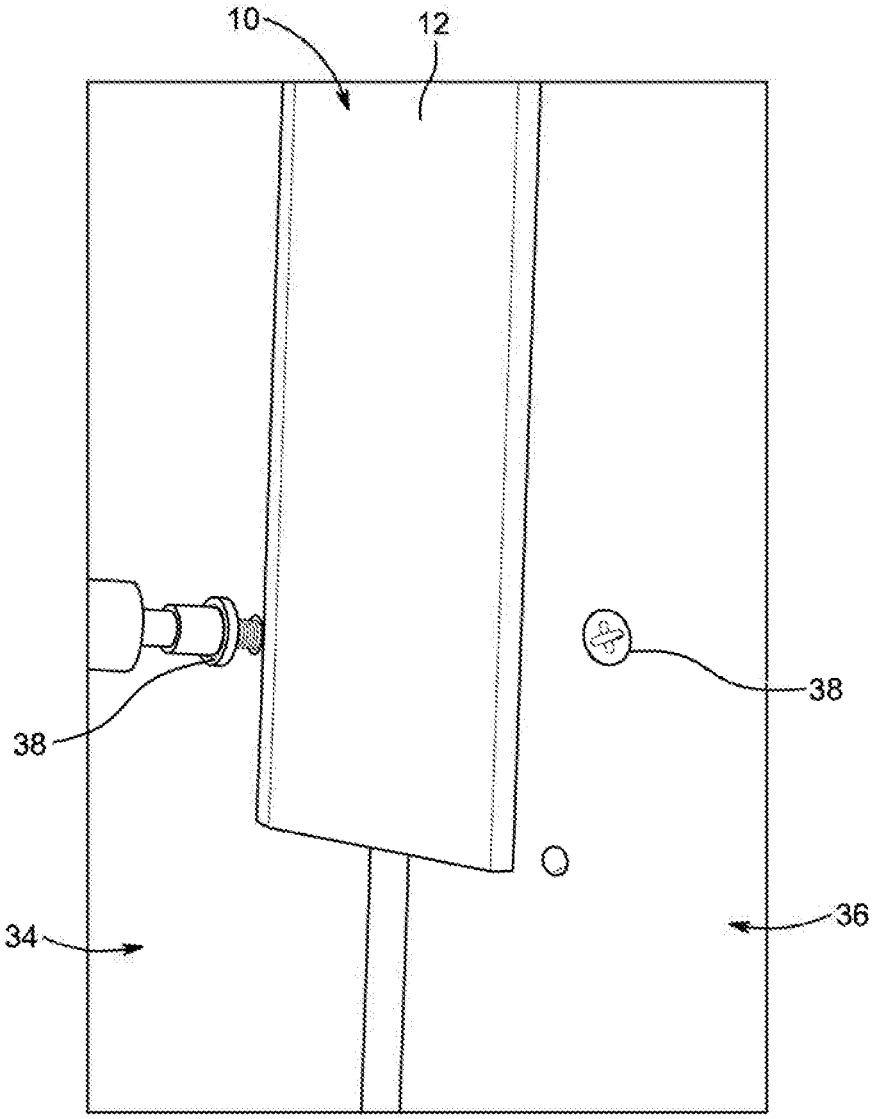
Figure 4K:
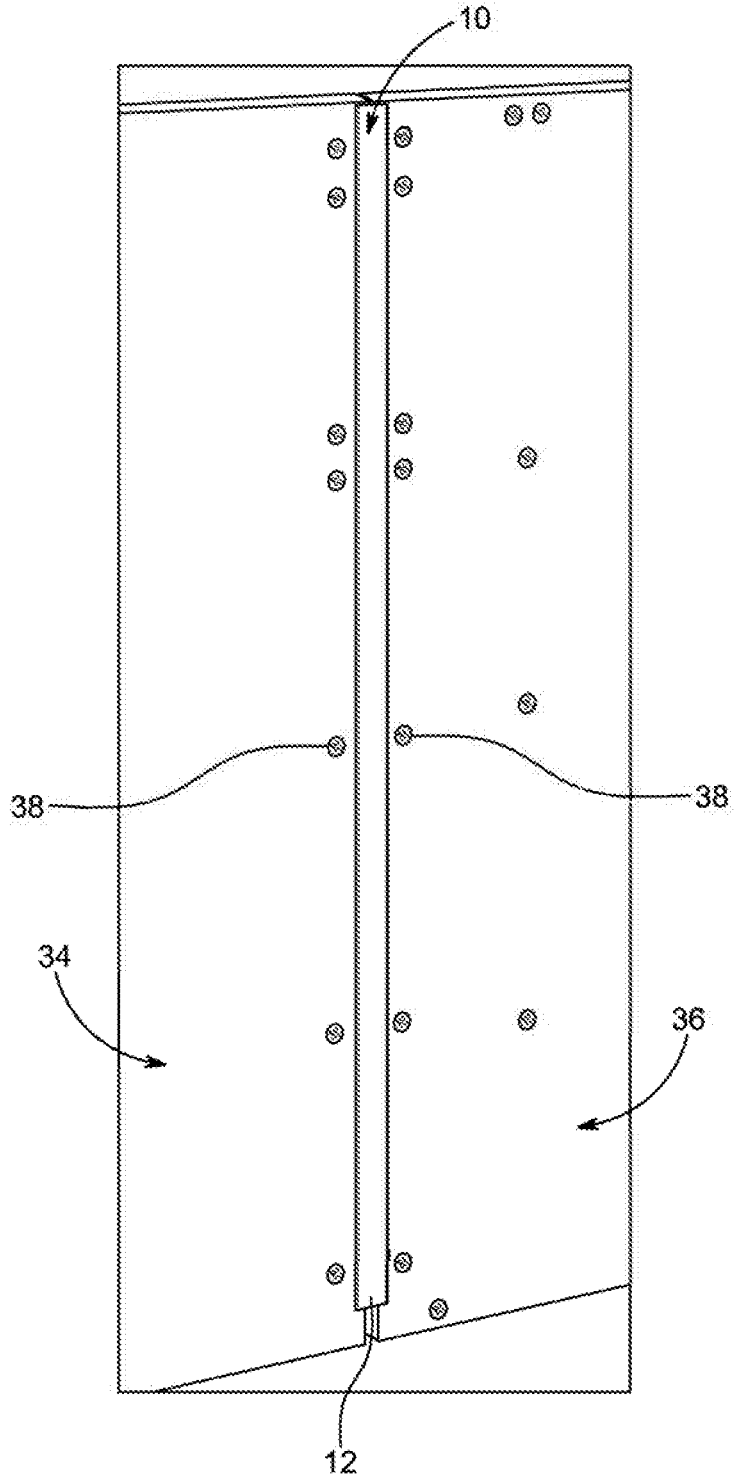

After the two sections of the sheet material are adjoined through the connector, fasteners 38 are driven through the exposed side of the sections of the sheet material and into the front face of the rear walls 16. As the fasteners 38 are tightened the convex arced rear wall is pulled inward toward the back side of the sheet materials thereby increasing the force applied by the convex arced rear wall of the connector on the adjoined edges of the sheet material. (Exemplary illustrations of these steps are provided in FIGS. 4*h* to 4*j*.) Although a specific number of fasteners are depicted in the final wall construction shown in FIG. 4*k*, it will be understood that any number and arrangement of fasteners may be used to secure the sections of sheet material in the connector. In addition, any suitable fastener may be used, such as, for example, standard coarse thread drywall screws or others.

Figure 5A:
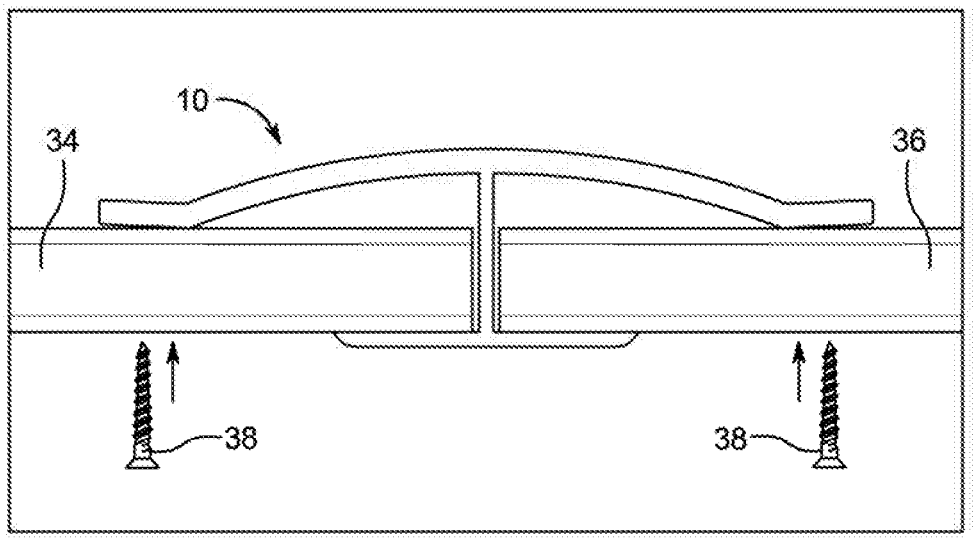
FIGS. 5*a* and 5*b* provide close-up schematic of two sections of wall sheet material joined together using a sheet material joining apparatus according to embodiments.
Figure 5B:
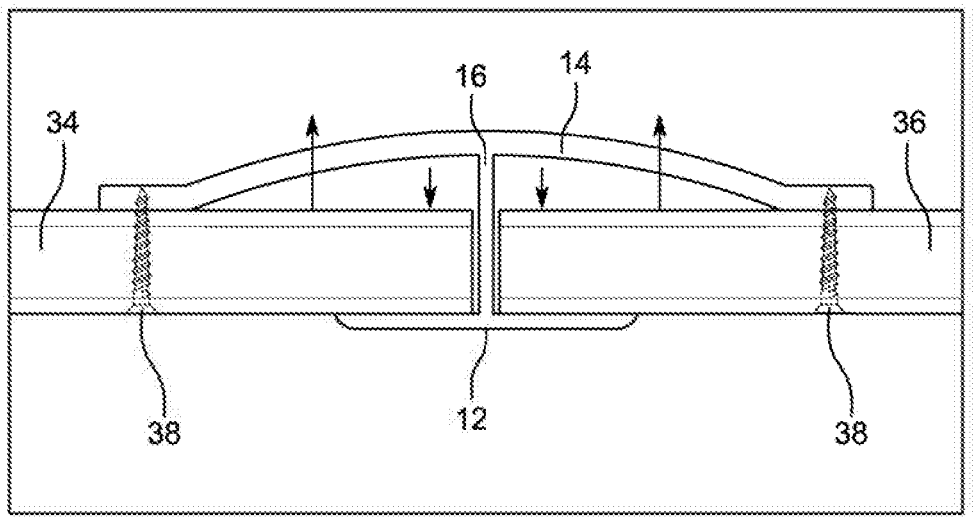

As shown in FIGS. 5*a* and 5*b*, the result of the operation of the fasteners 38 on the connector 10 is that the back wall 14 of the connector is flattened and pulled toward the sheet material (as shown by arrows) resulting in the edges of the sections 34 and 36 of sheet material being pulled inward toward the back wall 14 of the connector (as also shown by arrows). The combination of these forces creates a slight depression in the exposed face of the finished wall. Once the sections of the wall are joined, the joint of the wall may be finished using standard techniques, such as, for example, finishing tape and/or a finishing compound to fill the depression and cover the joint between the adjoined ends of the sheet material sections, thereby establishing a smooth, flat finished surface that conceals the connectors and joiner of the sections. As a result, an even appearance in the finished wall structure is provided by virtue of employment of the device of the present invention.

Figure 6A:
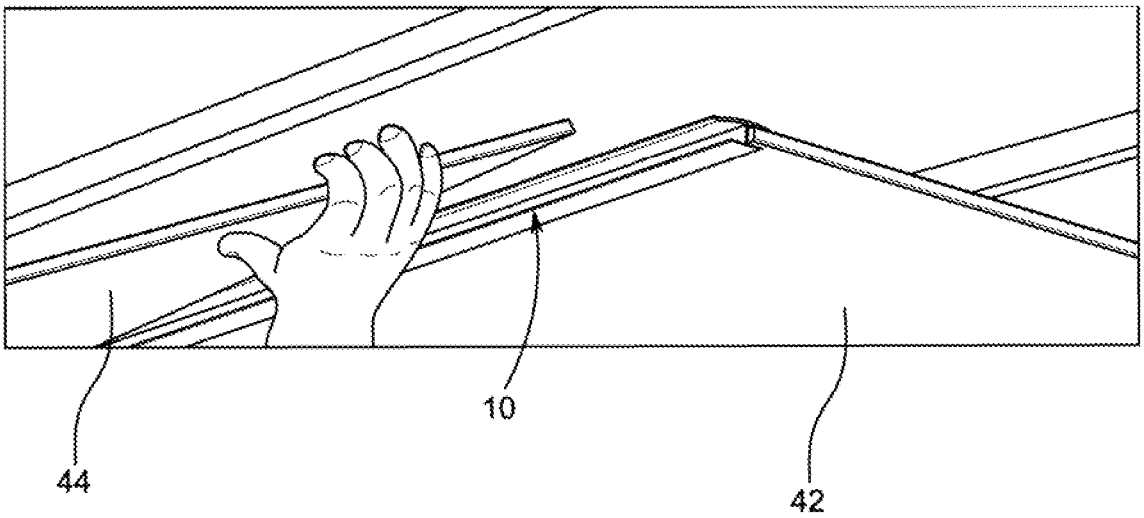
FIGS. 6*a* and 6*b* provide schematics of a process for using a sheet material joining apparatus according to embodiments to join two sections of ceiling sheet material together according to embodiments.
Figure 6B:
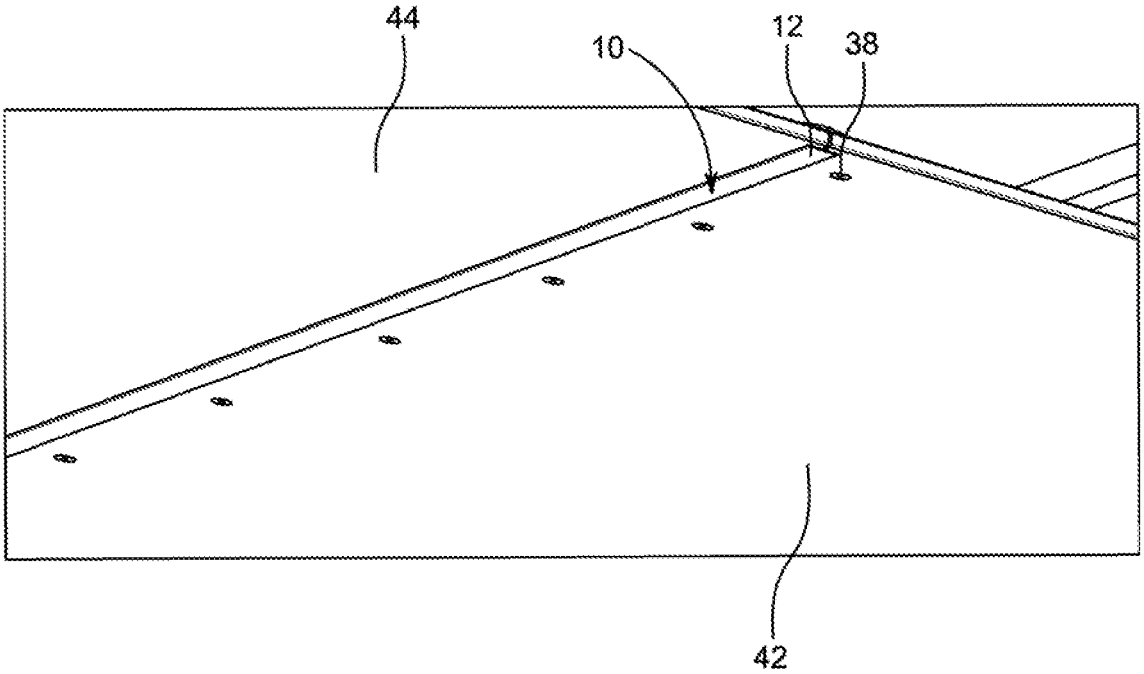

As discussed previously, the connector 10 of the present invention can be employed in connection with installing, repairing or patching a damaged wall section. Alternatively, as shown in FIGS. 6*a* and 6*b*, the connector can also be used as a sealing joist for installing ceiling panels and reinforcing them against sag, particularly where a suspended ceiling is in place. In such an application, as shown in the figures, a connector 10 is installed on a preinstalled section of sheet material 42 to thereby provide the needed reinforcement for supporting subsequent sheet material sections 44.

Figure 7A:
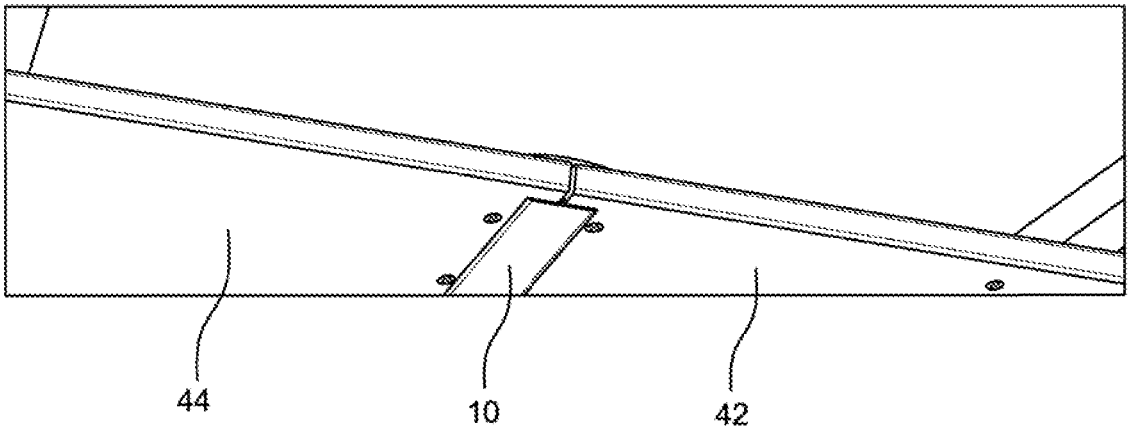
FIGS. 7*a* to 7*c* provide close-up schematics of two sections of ceiling sheet material joined together using a sheet material joining apparatus according to embodiments.
Figure 7B:
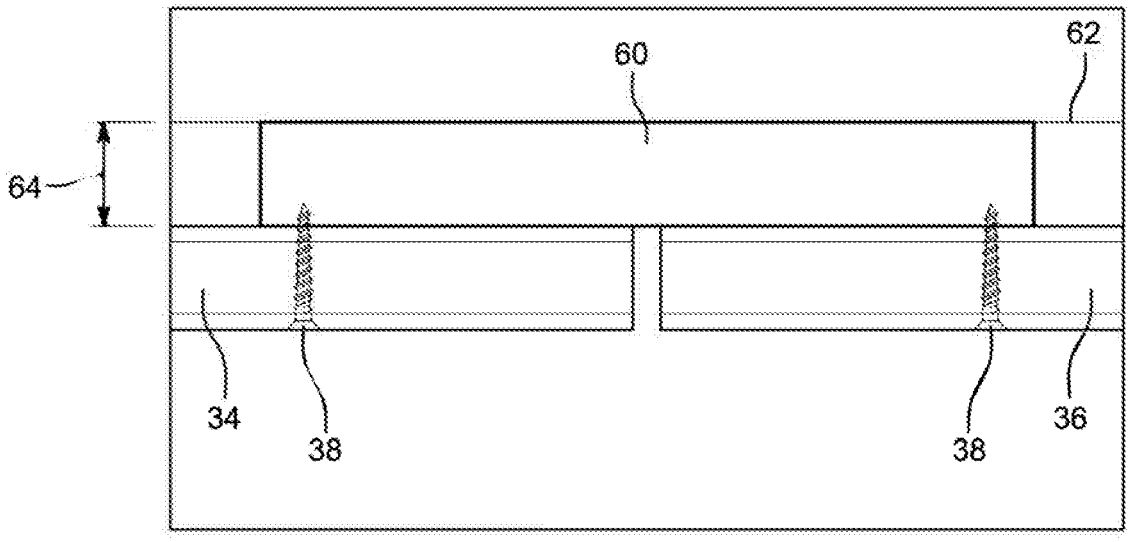
Figure 7C:
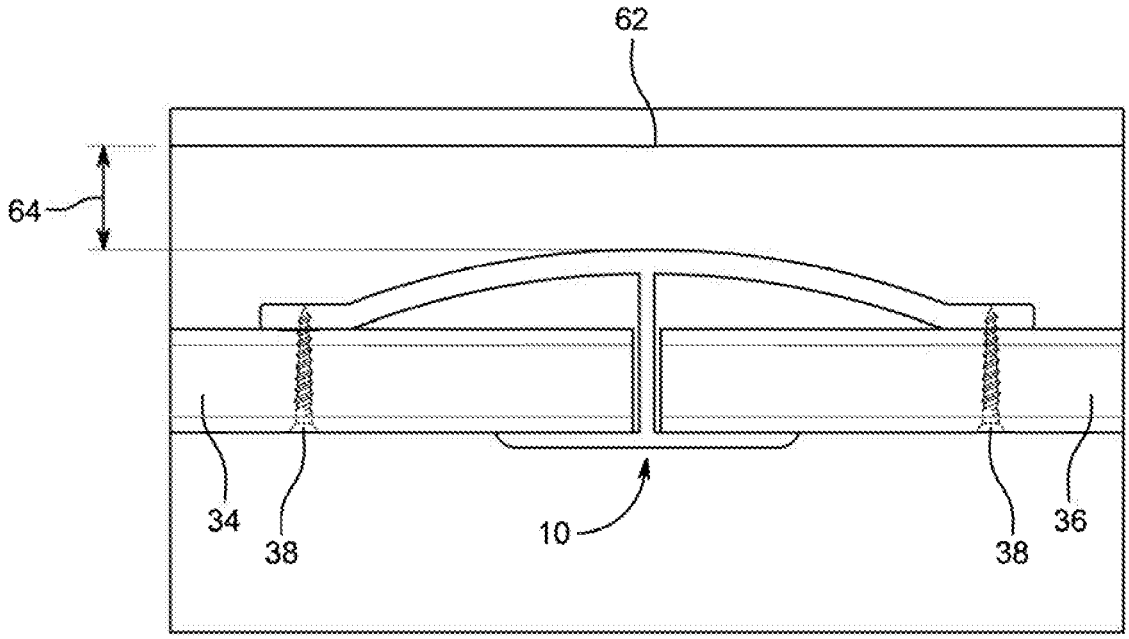

As in the embodiments shown in FIGS. 5*a* and 5*b*, installation of a connector on sheet materials for ceiling panels also leads the creation of a depression at the joint between the sheet materials. An exemplary embodiment is depicted in FIGS. 7*a* to 7*c*. As shown, when two sections 42 and 44 are joined by a connector 10 (see FIG. 7*a*) the joint of the two edges 34 and 36 of the sheet material are drawn inward (see FIG. 7*c*) when compared to the portions of the sheet material disposed at a support 60, such as a stud (see FIG. 7*c*). The result of this drawing inward is a gap 64 formed between the edges 34 and 36 of the sheet material and a plane or back wall 62 formed behind the sheet material would be smaller when using the sheet connector 10 as compared to sheet material interconnected with a structural support such as a stud. Accordingly, as with the wall sections, such ceiling sections may be finished smoothly with no bulging or other discontinuity in the finished ceiling.

Using the sheet material connectors in accordance with embodiments, it is not only possible to obtain better joining (as described in detail above), but to allow the joints between the sheet material to occur at random along the new construction, regardless of the position of the underlying supports. More specifically, it is possible to use the sheet material connector according to embodiments to serve as a replacement support where two sheets of material do not happen to align with an underlying stud. As a result of this capability, the speed of construction can be accelerated, and the amount of material wastage can be reduced.

DOCTRINE OF EQUIVALENTS

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A sheet material connector comprising:

an elongated body having first and second walls disposed parallel to one another and interconnected at the midpoint thereof by a connecting wall disposed perpendicular thereto;

wherein the second wall is an elongated planar surface having a substantially curved section defining an arc concave to the connecting wall, and has a width greater than the first wall and is configured to be disposed on a hidden side of a sheet material;

wherein the distance between the first and second walls defines a pair of channels separated by the connecting wall, each configured to accept a portion of a sheet material body therein; and wherein the curved surface of the second wall is configured to apply a resilient force to the portion of the sheet material body disposed within the pair of channels by way of an attachment means.

2. The sheet material connector of claim 1, wherein the longitudinal edges of the second wall are angled outward from the pair of channels.

3. The sheet material connector of claim 1, wherein the sheet material connector is formed of a material selected from the group consisting of metal, polymeric materials and cellulosic materials.

4. The sheet material connector of claim 1, wherein the sheet material connector is translucent.

5. The sheet material connector of claim 1, wherein the width of the pair of channels is selected from the group consisting of ¼ inch, ½ inch, ⅝ inch, and ¾ inch.

6. The sheet material connector of claim 1, wherein the first wall is a substantially flat elongated planar surface.

7. The sheet material connector of claim 1, wherein the connecting wall is a substantially flat elongated planar surface.

8. A method for adjoining sections of sheet material comprising:

providing a sheet material connector comprising:

an elongated body having first and second walls disposed parallel to one another and interconnected at the midpoint thereof by a connecting wall disposed perpendicular thereto, wherein the second wall is an elongated planar surface having a substantially curved section defining an arc concave to the connecting wall, and has a width greater than the first wall, wherein the distance between the first and second walls defines a pair of channels separated by the connecting wall, each configured to accept a portion of a sheet material body therein;

inserting a portion of different sheet material bodies into each of the channels, such that the first wall overlaps an outer front surface of each of the different sheet material bodies and such that the second wall overlaps an outer back surface of each of the different sheet material bodies, and wherein the ends of the sheet material bodies abut adjacent the connecting wall; and inserting at least one fastener through the outer front surface of each of the different sheet material bodies and into the second wall, and tightening each of the at least one fasteners such that the curved elongated planar surface of the second wall applies a resilient force to the ends of each of the different sheet material bodies to draw said ends back toward the second wall.

9. The method of claim 8, wherein the longitudinal edges of the second wall are angled outward from the pair of channels.

10. The method of claim 8, wherein the sheet material connector is formed of a material selected from the group consisting of metal, polymeric materials and cellulosic materials.

11. The method of claim 8, wherein the sheet material connector is translucent.

12. The method of claim 8, wherein the width of the pair of channels is selected from the group consisting of ¼ inch, ½ inch, ⅝ inch, and ¾ inch.

13. The method of claim 8, wherein the first wall is a substantially flat elongated planar surface.

14. The method of claim 8, wherein the connecting wall is a substantially flat elongated planar surface.

15. The method of claim 8, wherein the sheet material is drywall.

16. The method of claim 8, wherein a plurality of fasteners are inserted through the outer front surface of each of the different sheet material bodies.

17. The method of claim 8, wherein the fasteners are threaded fasteners.

18. The method of claim 8, wherein the sheet material connector is installed on a vertical surface.

19. The method of claim 8, wherein the sheet material connector is installed on a horizontal surface.

* * * * *